US011328917B2

(12) United States Patent
Brown

(10) Patent No.: US 11,328,917 B2
(45) Date of Patent: May 10, 2022

(54) MALDI TARGET PLATE

(71) Applicant: Micromass UK Limited, Wilmslow (GB)

(72) Inventor: Jeffery Mark Brown, Hyde (GB)

(73) Assignee: Micromass UK Limited, Wilmslow (GB)

( * ) Notice: Subject to any disclaimer, the term of this patent is extended or adjusted under 35 U.S.C. 154(b) by 103 days.

(21) Appl. No.: 16/604,740

(22) PCT Filed: Apr. 12, 2018

(86) PCT No.: PCT/GB2018/050973
§ 371 (c)(1),
(2) Date: Oct. 11, 2019

(87) PCT Pub. No.: WO2018/189544
PCT Pub. Date: Oct. 18, 2018

(65) Prior Publication Data

US 2021/0166930 A1 Jun. 3, 2021

(30) Foreign Application Priority Data

Apr. 13, 2017 (GB) ..... 1705981

(51) Int. Cl.
*H01J 49/04* (2006.01)
*H01J 49/16* (2006.01)

(52) U.S. Cl.
CPC ..... *H01J 49/0418* (2013.01); *H01J 49/0431* (2013.01); *H01J 49/164* (2013.01)

(58) Field of Classification Search
CPC .... H01J 49/04; H01J 49/0418; H01J 49/0431; H01J 49/164
See application file for complete search history.

(56) References Cited

U.S. PATENT DOCUMENTS 6,140,639 A 10/2000 Gusev et al.
7,180,058 B1 * 2/2007 Izgarian ..... H01J 27/24 250/281

(Continued)

FOREIGN PATENT DOCUMENTS

WO 200123863 A2 4/2001
WO 2003081205 A2 10/2003
WO 2005008244 A1 1/2005

OTHER PUBLICATIONS

Search Report for United Kingdom Application No. GB1705981.7, dated Oct. 13, 2017, 5 pages.

(Continued)

*Primary Examiner* — David E Smith

(57) ABSTRACT

A MALDI ion source is disclosed comprising: a target plate (2) having a front surface (4), a rear surface (6), and at least one sample receiving well (9) for receiving a liquid sample or at least one sample receiving channel (8) extending from an opening (12) in the rear surface (6) to an opening (14) in the front surface (4) for receiving a liquid sample (10), wherein each well (9) or channel (8) has a volume of ≥1 μL. The ion source also comprise a laser (16) for ionising a liquid sample (10) on or in the target plate (2), wherein the laser (16) is a pulsed laser set up and configured to have a pulsed repetition rate of ≥20 Hz, or is a continuous laser.

20 Claims, 4 Drawing Sheets

(56) References Cited

U.S. PATENT DOCUMENTS

| | | | | |
|---|---|---|---|---|
| 2003/0052268 | A1* | 3/2003 | Doroshenko | H01J 49/04 250/288 |
| 2003/0178563 | A1* | 9/2003 | Makarov | H01J 49/0418 250/288 |
| 2004/0119013 | A1* | 6/2004 | Schleifer | H01J 49/0418 250/288 |
| 2004/0217278 | A1* | 11/2004 | Overney | H01J 49/0027 250/288 |
| 2006/0124846 | A1* | 6/2006 | Covey | H01J 49/164 250/288 |
| 2006/0266941 | A1* | 11/2006 | Vestal | H01J 49/0418 250/288 |
| 2008/0168941 | A1* | 7/2008 | Haynes | E01F 9/617 116/63 R |
| 2009/0039245 | A1 | 2/2009 | Brown et al. | |
| 2017/0358436 | A1* | 12/2017 | Naito | H01J 49/0418 |

OTHER PUBLICATIONS

International Search Report and Written Opinion for International Patent Application No. PCT/GB2018/050973, dated Jul. 16, 2018, 16 pages.

Brabeck, G. F., et al., "Characterization of quadrupole mass filters operated with frequency-asymmetric and amplitude-asymmetric waveforms", International journal of Mass Spectrometry 404:8-13 (2016).

* cited by examiner

MALDI TARGET PLATE

CROSS-REFERENCE TO RELATED APPLICATIONS

This application is a national phase filing claiming the benefit of and priority to International Patent Application No. PCT/GB2018/050973, filed on Apr. 12, 2018, which claims priority from and the benefit of United Kingdom patent application No. 1705981.7 filed on Apr. 13, 2017. The entire contents of these applications are incorporated herein by reference.

FIELD OF THE INVENTION

The present invention relates generally to mass spectrometers and in particular to target plates for use in holding a liquid sample in an ion source.

BACKGROUND

It is known in mass spectrometry to deposit a sample on a target plate and then ionise that sample. For example, Matrix-Assisted Laser Absorption Ionization (MALDI) techniques are known in which an analyte sample solution is mixed with a solution containing dissolved matrix crystals, deposited onto a metal target plate and allowed to dry. A pulsed laser is then fired at the dried sample mixture, which is absorbed by the matrix crystals, causing desorption and ionisation of the matrix to form a gaseous plume. The ionised matrix then serves to ionise the analyte in the plume. The resulting analyte ions are then mass analysed.

MALDI techniques are also known in which the laser is fired at a liquid solution of sample and matrix on the target plate. Such techniques may be performed at atmospheric pressure, i.e. may be AP-MALDI techniques. It has been found that analyte ion signals generated from liquid samples analysed by AP-MALDI mass spectrometry are significantly more stable and persistent than ion signals generated from conventional dried crystalline MALDI samples. Typically, in liquid AP-MALDI techniques the laser is a UV laser operated at a pulsed frequency of 1-20 Hz. This may be used, for example, to substantially continuously generate multiply protonated peptide ions from a sample, typically having a loading of only 1 μL (equivalent to ~30 pico-litres per laser shot). As such, stable ion signals can persist for at least an hour. The optimum laser energy for desorption is around 10 or 20 μJ per laser shot, so it is beneficial to operate at this laser energy even though the analysis is relatively slow.

SUMMARY

From a first aspect the present invention provides a MALDI ion source comprising: a target plate having a front surface, a rear surface, and at least one sample receiving well for receiving a liquid sample or at least one sample receiving channel extending from an opening in the rear surface to an opening in the front surface for receiving a liquid sample, wherein each well or channel has a volume of ≥1 μL; and a laser for ionising a liquid sample on or in the target plate, wherein the laser is a pulsed laser set up and configured to have a pulsed repetition rate of ≥20 Hz, or is a continuous laser.

In known liquid MALDI analysis, a liquid sample droplet is placed on the upper, flat surface of the MALDI target plate. The loading volume of each droplet is limited, because the surface tension of the droplet must hold the droplet in place on the target plate. However, according to embodiments of the present invention, the target plate includes at least one well or channel for receiving the liquid sample. The sample is therefore partially confined and so may have a significantly larger loading volume than conventional target plates. The channel also enables the sample to be loaded onto the target plate in new manners, e.g. from the rear side of the target plate.

As the target plate enables larger volume samples to be loaded, the rate at which the sample is desorbed may be made relatively high without desorbing the entire sample too quickly. For example, if a pulsed laser is used to desorb the sample, the repetition/pulse rate of the laser may be made relatively high. Alternatively, a continuous laser may be used. The use of a MALDI laser having such a high pulsed repetition rate (or a continuous laser) enables a more intense analyte ion signal to be generated per unit time.

The target plate and laser position may be maintained stationary so that the laser beam is incident on the same sample position for at least X pulses, wherein X is 2, 3, 4, 5, 6, 7, 8, 9, 10, 15, 20, 30, 40, 50, 60, 70, 80, 90, 100, 200, 300, 400, 500, 600, 700, 800, 900, 1000, 2000, 3000, 4000, 5000, 6000, 7000, 8000, 9000, 10000, or 20000.

The rear side of the target plate may be the side facing away from the laser source. Alternatively, or additionally, the ion source may be part of a mass or ion mobility spectrometer having an inlet for receiving ions from the ion source, and the rear side of the target plate may be the side arranged facing away from the inlet. Conversely, the front side of the target plate may be the side facing towards the laser source and/or the inlet.

For any given channel, the opening on the rear side of the target plate may have a larger area than the opening on the front side of the target plate. Alternatively, any given channel may have the same size opening in the front and rear sides of the target plate.

Each channel may have a cross-sectional area between the openings that is greater than the cross-sectional area of the front and/or rear openings.

The ion source may comprise at least one sample supply capillary connected to the opening in the rear side of target plate of the at least one channel.

The ion source may comprise a pump connected to the capillary for pumping the sample or another liquid to the channel through the capillary; and/or may comprise a liquid chromatography column connected to the opening in the rear side of target plate of the at least one channel.

The ion source may comprise a pump for creating a pressure differential between the rear and front openings of the at least one channel so as to urge sample towards the front opening.

The at least one channel may be configured such that desorption of the sample at the channel opening in the front side of the target plate draws the remainder of the sample through the channel under capillary action to the opening in the front side.

The laser may be arranged and configured to ionise the sample at or proximate the front opening of said channel, or in said channel.

The cross-sectional area of any given channel may continuously taper or may be stepped from a first area arranged towards the rear side of the target plate to a second smaller area arranged towards a front side of the target plate.

The cross-sectional area of any given channel may be progressively stepped in multiple steps from a first area arranged towards the rear side of the target plate to a second smaller area arranged towards a front side of the target plate.

Alternatively, each channel may have a constant cross-sectional area throughout the entirety of the channel.

The laser may be a pulsed laser having a laser pulse rate of: ≥30 Hz, ≥40 Hz, ≥50 Hz, ≥60 Hz, ≥80 Hz, ≥100 Hz, ≥200 Hz, ≥300 Hz, ≥400 Hz, ≥500 Hz, ≥600 Hz, ≥700 Hz, ≥800 Hz, ≥900 Hz, ≥1 kHz, ≥2 kHz, ≥3 kHz, ≥4 kHz, ≥5 kHz, ≥10 kHz, or ≥50 kHz.

Desirably, the sample may be in liquid form when ionised. The sample may comprise an analyte solution and a matrix, such as a MALDI matrix.

Each of said at least one channel or well may have a volume of: ≥2 μL, ≥3 μL, ≥4 μL, ≥5 μL, ≥10 μL, ≥20 μL, ≥30 μL, ≥40 μL, ≥50 μL, ≥60 μL, ≥70 μL, ≥80 μL, ≥90 μL, ≥100 μL, ≥200 μL, ≥300 μL, ≥400 μL, ≥500 μL, ≥600 μL, ≥700 μL, ≥800 μL, ≥900 μL, ≥1 mL, ≥2 mL, ≥3 mL, ≥4 mL, or ≥5 mL.

The volume of a channel may be considered to be the volume defined by the channel between the plane of the front surface of the target plate and the plane of the rear surface of the target plate (i.e. it is not necessary to consider the volume of a sample that may bulge out of the channel in use). Similarly, the volume of each well may be considered to be the volume defined between the plane of the front surface of the target plate and the bottom of the well (i.e. it is not necessary to consider the volume of a sample that may bulge out of the well in use).

The ion source may be an atmospheric pressure ion source.

The target plate may comprise a 1D or 2D array of said channels or wells spaced in the plane orthogonal to the direction between the front and rear surfaces of the target plate.

The ion source may comprise a laser controller for moving a laser beam from the laser between different ones of said channels or wells at different times; and/or may comprise a target plate carrier configured for moving the target plate so that the laser beam is incident on different ones of said channels or wells at different times. The ion source may comprise a position control system having one or more detector for sensing the laser beam and/or target plate position and a controller for controlling this position so as to direct the laser beam onto an opening of the channel or well.

The one or more detector may comprise a photodetector arranged on the opposite side of the target pate to the laser, optionally wherein the control system is configured to control the position of the laser beam and/or target plate so that the laser beam passes through the channel to be incident on the photodetector.

The laser may be configured to be focused or directed onto the front side of the target plate for ionising the sample.

The laser may be located on the front side of the target plate, or may be located on the rear side of the target plate and directed through the target plate so as to be focused or directed onto the channel at the front side of the target plate.

The ion source may comprise at least one voltage source arranged and configured for charging the liquid sample and to provide an electric field for urging the liquid sample through the channel or well towards the front side of the target plate.

It is contemplated that the MALDI ion source described herein need not necessarily have a channel volume of ≥1 μL. Alternatively, or additionally, the pulsed repetition rate of the laser need not be ≥20 Hz.

Accordingly, from a second aspect the present invention provides a MALDI ion source comprising: a target plate having a front surface, a rear surface and at least one channel for receiving a liquid sample, said at least one channel extending from an opening in the rear surface to an opening in the front surface; and a laser for ionising a sample on the target plate.

From a third aspect the present invention provides a MALDI ion source comprising: a target plate having at least one sample well extending only partially through the thickness of the target plate for receiving a liquid sample, wherein each well has a volume of ≥2 μL; and a laser for directing a laser beam onto the at least one well for ionising a sample in said well.

The use of a MALDI target plate having such wells enables the sample to be partially confined by the well, such that it may have a larger loading volume than conventional target plates. This enables the rate at which the sample is desorbed to be made relatively high without desorbing the entire sample too quickly. For example, if a pulsed laser is used to desorb the sample, the repetition/pulse rate of the laser may be made relatively high.

Any of the features described in relation to the first aspect of the invention may be provided for the ion source according to the second or third aspects of the invention.

It is also contemplated herein that the MALDI ion source according to the first aspect of the invention need not necessarily have the sample receiving well or channel described.

Accordingly, from a fourth aspect the present invention provides a MALDI ion source comprising: a target plate; and a laser for ionising a liquid sample on the target plate, wherein the laser is a pulsed laser set up and configured to have a pulsed repetition rate of >20 Hz, or is a continuous laser.

Although ion sources have been described, the target plate itself is considered to be novel and inventive in its own right.

Accordingly, the present invention also provides a MALDI target plate comprising a front surface, a rear surface and at least one channel for receiving a liquid sample, said at least one channel extending from an opening in the rear surface to an opening in the front surface.

The target plate may have any of the target plate features described herein, for example, particularly any of those described in relation to the first or second aspects of the present invention.

The present invention also provides a MALDI target plate comprising at least one sample well extending only partially through the thickness of the target plate for receiving a liquid sample, wherein each well has a volume of ≥2 μL.

The target plate may have any of the target plate features described herein, for example, particularly any of those described in relation to the first, second or third aspects of the present invention.

Although embodiments have been described in which the sample is ionised by a MALDI technique, it is contemplated that the target plate may be used in other ionisation techniques, such as Laser Desorption Ionisation ("LDI"), Solvent Assisted Inlet Ionisation ("SAII"), Desorption Electrospray Ionisation ("DESI"), Rapid Evaporative Ionization Mass Spectrometry (REIMS), Laserspray Ionisation ("LSI"), Atmospheric Sample Analysis Probe (ASAP) ionisation or other ambient ionization techniques.

Accordingly, the present invention also provides an ion source comprising: a target plate having a front surface, a rear surface and at least one channel extending from an opening in the rear surface to an opening in the front surface for receiving a liquid sample; and an ionisation device for ionising the sample in, or leaving, said at least one channel.

The present invention also provides an ion source comprising: a target plate having at least one sample well extending only partially through the thickness of the target plate for receiving a liquid sample, wherein each well has a volume of ≥2 μL; and an ionisation device for ionising the sample in, or leaving, said at least one channel.

The ionisation device may be a source of photons, ions, electrons or electrically charged droplets and is arranged and configured to direct the photons, ions, electrons or charged droplets towards the one or more channel or well; or the ionisation device may be an RF voltage source or ultrasonic source arranged and configured to apply an RF voltage or ultrasound to the liquid sample so as to ionise it.

The present invention also provides a target plate for holding a sample in an ion source, the target plate comprising a front surface, a rear surface and at least one channel for receiving a liquid sample, said at least one channel extending from an opening in the rear surface to an opening in the front surface.

The present invention also provides a target plate for holding a sample in an ion source, the target plate comprising at least one sample well extending only partially through the thickness of the target plate for receiving a liquid sample, wherein each well has a volume of ≥2 μL.

The present invention also provides a mass spectrometer or ion mobility spectrometer comprising the ion source described herein and a mass analyser and/or ion mobility analyser for analysing ions from the ion source, or product ions thereof.

The present invention also provides a method of ionising a sample comprising: providing an ion source as described herein; providing a liquid sample to said target plate; and ionising said sample.

The step of providing the liquid sample to said target plate may comprise providing the liquid sample to the at least one well or channel.

The step of ionising the sample may be performed by directing the laser onto the sample.

The sample may be a liquid sample and said step of ionising the sample may be performed by directing the laser onto the liquid sample.

The method may comprise driving the liquid sample through the target plate whilst ionising said liquid sample on or in the target plate; and/or ionisation of the liquid sample on or in the target plate may draw the sample through the at least one sample receiving well or channel. For example, the liquid sample may be electrically charged and driven through the target plate by an electric field. Alternatively, or additionally, the ionisation of the liquid sample may draw the sample through the at least one sample receiving well or channel in the target plate by capillary action.

The present invention also provides a method of mass or ion mobility spectrometry comprising the method of ionising a sample described herein. The method of spectrometry comprises mass or ion mobility analysing the ionised sample. This may be performed whilst the liquid sample is being driven or drawn through the target plate and ionised.

The spectrometer described herein may comprise an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; (xxviii) a Laser Ablation Electrospray Ionisation ("LAESI") ion source; and (xxix) a Surface Assisted Laser Desorption Ionisation ("SALDI") ion source.

The spectrometer may comprise one or more continuous or pulsed ion sources.

The spectrometer may comprise one or more ion guides.

The spectrometer may comprise one or more ion mobility separation devices and/or one or more Field Asymmetric Ion Mobility Spectrometer devices.

The spectrometer may comprise one or more ion traps or one or more ion trapping regions.

The spectrometer may comprise one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device.

The ion-molecule reaction device may be configured to perform ozonlysis for the location of olefinic (double) bonds in lipids.

The spectrometer may comprise a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser.

The spectrometer may comprise one or more energy analysers or electrostatic energy analysers.

The spectrometer may comprise one or more ion detectors.

The spectrometer may comprise one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter.

The spectrometer may comprise a device or ion gate for pulsing ions; and/or a device for converting a substantially continuous ion beam into a pulsed ion beam.

The spectrometer may comprise a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser.

The spectrometer may comprise a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

The spectrometer may comprise a device arranged and adapted to supply an AC or RF voltage to the electrodes. The AC or RF voltage optionally has an amplitude selected from the group consisting of: (i) about <50 V peak to peak; (ii) about 50-100 V peak to peak; (iii) about 100-150 V peak to peak; (iv) about 150-200 V peak to peak; (v) about 200-250 V peak to peak; (vi) about 250-300 V peak to peak; (vii) about 300-350 V peak to peak; (viii) about 350-400 V peak to peak; (ix) about 400-450 V peak to peak; (x) about 450-500 V peak to peak; and (xi) >about 500 V peak to peak.

The AC or RF voltage may have a frequency selected from the group consisting of: (i) <about 100 kHz; (ii) about 100-200 kHz; (iii) about 200-300 kHz; (iv) about 300-400 kHz; (v) about 400-500 kHz; (vi) about 0.5-1.0 MHz; (vii) about 1.0-1.5 MHz; (viii) about 1.5-2.0 MHz; (ix) about 2.0-2.5 MHz; (x) about 2.5-3.0 MHz; (xi) about 3.0-3.5 MHz; (xii) about 3.5-4.0 MHz; (xiii) about 4.0-4.5 MHz; (xiv) about 4.5-5.0 MHz; (xv) about 5.0-5.5 MHz; (xvi) about 5.5-6.0 MHz; (xvii) about 6.0-6.5 MHz; (xviii) about 6.5-7.0 MHz; (xix) about 7.0-7.5 MHz; (xx) about 7.5-8.0 MHz; (xxi) about 8.0-8.5 MHz; (xxii) about 8.5-9.0 MHz; (xxiii) about 9.0-9.5 MHz; (xxiv) about 9.5-10.0 MHz; and (xxv) >about 10.0 MHz.

The spectrometer may comprise a chromatography or other separation device upstream of an ion source. The chromatography separation device may comprise a liquid chromatography or gas chromatography device. Alternatively, the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide may be maintained at a pressure selected from the group consisting of: (i) <about 0.0001 mbar; (ii) about 0.0001-0.001 mbar; (iii) about 0.001-0.01 mbar; (iv) about 0.01-0.1 mbar; (v) about 0.1-1 mbar; (vi) about 1-10 mbar; (vii) about 10-100 mbar; (viii) about 100-1000 mbar; and (ix) >about 1000 mbar.

Analyte ions may be subjected to Electron Transfer Dissociation ("ETD") fragmentation in an Electron Transfer Dissociation fragmentation device. Analyte ions may be caused to interact with ETD reagent ions within an ion guide or fragmentation device.

The multiply charged analyte cations or positively charged ions may comprise peptides, polypeptides, proteins or biomolecules.

A chromatography detector may be provided, wherein the chromatography detector comprises either: a destructive chromatography detector optionally selected from the group consisting of (i) a Flame Ionization Detector (FID); (ii) an aerosol-based detector or Nano Quantity Analyte Detector (NQAD); (iii) a Flame Photometric Detector (FPD); (iv) an Atomic-Emission Detector (AED); (v) a Nitrogen Phosphorus Detector (NPD); and (vi) an Evaporative Light Scattering Detector (ELSD); or a non-destructive chromatography detector optionally selected from the group consisting of: (i) a fixed or variable wavelength UV detector; (ii) a Thermal Conductivity Detector (TCD); (iii) a fluorescence detector; (iv) an Electron Capture Detector (ECD); (v) a conductivity monitor; (vi) a Photoionization Detector (PID); (vii) a Refractive Index Detector (RID); (viii) a radio flow detector; and (ix) a chiral detector.

The spectrometer may be operated in various modes of operation including a mass spectrometry ("MS") mode of operation; a tandem mass spectrometry ("MS/MS") mode of operation; a mode of operation in which parent or precursor ions are alternatively fragmented or reacted so as to produce fragment or product ions, and not fragmented or reacted or fragmented or reacted to a lesser degree; a Multiple Reaction Monitoring ("MRM") mode of operation; a Data Dependent Analysis ("DDA") mode of operation; a Data Independent Analysis ("DIA") mode of operation a Quantification mode of operation or an Ion Mobility Spectrometry ("IMS") mode of operation.

BRIEF DESCRIPTION OF THE DRAWINGS

Various embodiments will now be described, by way of example only, and with reference to the accompanying drawings in which.

DETAILED DESCRIPTION

Embodiments of the present invention relate to sample analysis using pulsed lasers operating at a relatively high rate. The operation of such faster lasers (e.g. kHz lasers) has not been demonstrated previously. However, it has been realised that for pulsed laser rates up to 1 kHz, e.g. in an AP-MALDI ion source, the ion current generated may be linearly proportional to the laser firing rate.

Operating the pulsed laser at such high repetition rates enables the experiment time to be reduced, since the sample may ionised and hence analysed more rapidly. In conventional MALDI techniques the sample is deposited on the target plate as laterally spaced droplets and the laser is moved between the droplets so as to ionise the material therein. Each of the sample droplets is held in place on the target plate by its surface tension, which limits the volume that the droplet can have. Typically, sample droplets exceeding around 1-2 μL in volume will "burst" and spill onto adjacent sample droplets. As the sample size of any given droplet in conventional MALDI techniques is so low, sample depletion would be a problem if operating the pulsed laser at higher rates.

The inventor has realised the above problems and recognised that they may be overcome or mitigated by use of the embodiments described herein.

Figure 1:
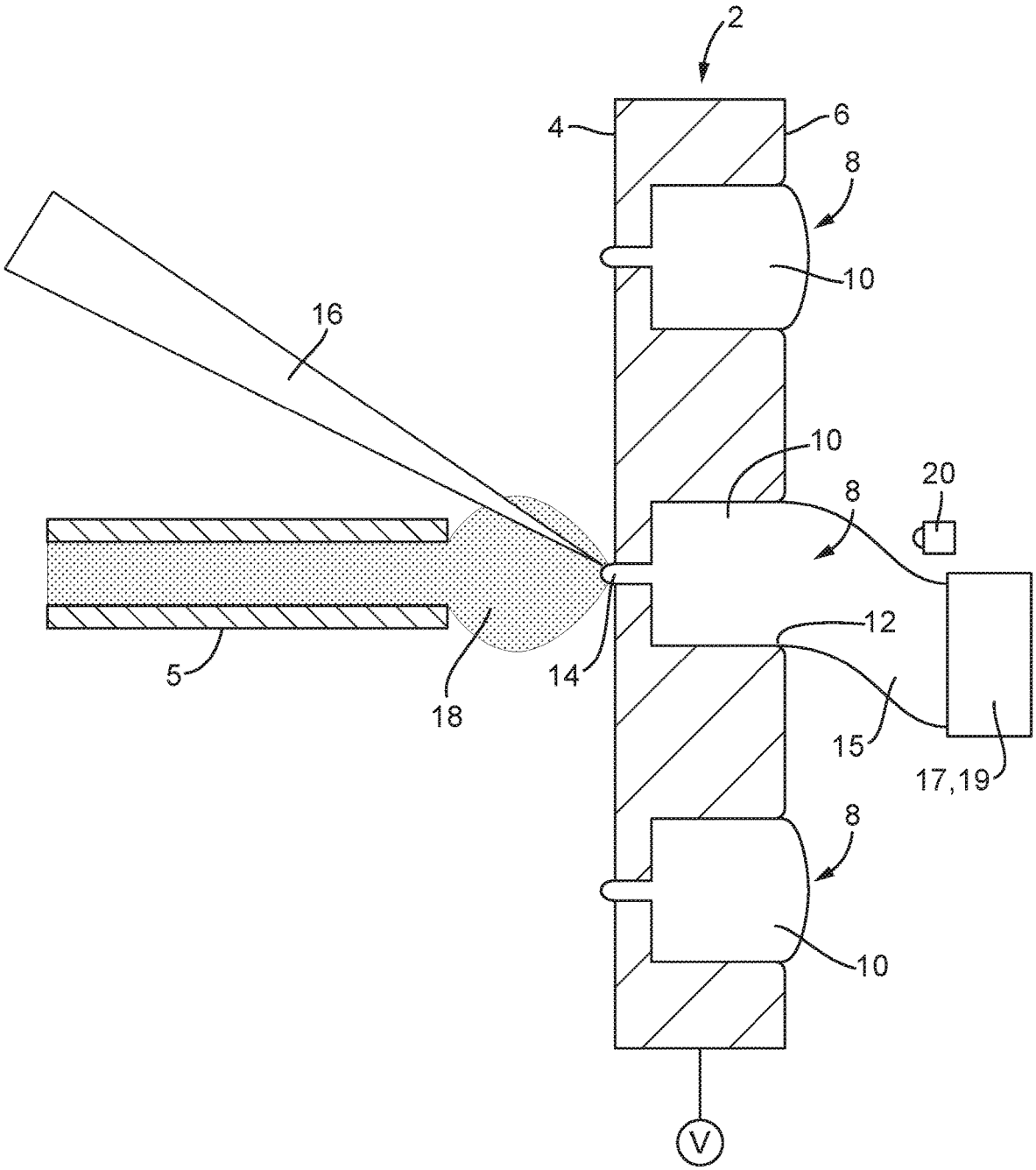
FIG. 1 shows a target plate according to an embodiment of the present invention having sample receiving channels.

FIG. 1 shows a schematic of a target plate 2 according to an embodiment of the present invention. The target plate 2 comprises a front side 4 for being arranged towards the inlet or inlet tube 5 of a mass spectrometer and an opposing rear side 6. The target plate 2 comprises a plurality of channels 8 extending through it from the rear side 6 to the front side 4, and for receiving sample 10 to be analysed. The target plate 2 may comprise a 1D or 2D array of such channels 8 through the target plate 2 (or even only a single such channel). The opening 12 of each channel 8 on the rear side 6 of the target plate 2 may be relatively large, whereas the opening 14 of each channel 8 on the front side 4 of the target plate 2 may be smaller than its opening 12 on the rear side 6. For example, each opening 14 in the front side 4 may be circular and have a diameter of 0.1 to 0.2 mm. The narrowing of each channel 8 from the rear side to the front side enables each channel 8 to have a relatively large volume for holding a relatively large sample 10 (e.g. 5-100 μL or higher), whilst providing a relatively small sample area at the front side 4 of the target plate 2 so that a relatively small laser spot can be efficiently used to illuminate and desorb the sample at the front side 4. As each channel 8 is able to hold a relatively large sample 10, a laser 16 may be used that is operated at a relatively high pulse rate without depleting the sample 10 in each channel 8 too quickly. For example, the laser 16 may be operated at a repetition rate exceeding 20 Hz.

In the embodiment shown in FIG. 1, each channel 8 has a first length of constant cross-sectional size extending from the rear side 6 of the target plate 2 into the plate, connected to a second length of smaller constant cross-sectional size extending from the front side 4 of the target plate 2. However, other channel configurations are contemplated. For example, the channels 8 may taper down in other manners towards the front side of the target plate, such as by tapering continuously or in a conical fashion. Alternatively, the channel 8 may have the same size opening in the front and rear sides of the target plate (or may even have a smaller opening in the rear side than the front side), but may have a length between the front and rear openings of a cross-sectional area that is larger than that of the front and/or rear openings. Alternatively, it is contemplated that the entire channel 8 may have a constant cross-sectional area throughout, i.e. which is the same as that of the openings in the front and rear sides. This still allows a large sample volume loading per channel, since the sample volume may be defined by the thickness of the target plate (rather than the surface tension of the sample, as in conventional techniques where the samples are deposited on top of the front surface of the target plate). It is contemplated that the channel 8 may even have a cross-sectional area between the front and rear openings that is smaller than that of the rear and/or front openings.

In operation, one or more sample 10 to be analysed is loaded into the channels 8 in the target plate 2 through their openings 12,14 in the rear and/or front sides 4,6. This may be achieved by loading the sample(s) 10 into the openings 12 in the rear sides 6. This avoids having to interfere with any instrument components adjacent the front side 4 of the target plate 2. This also enables one or more sample source to remain connected to the channel 8, even when the laser 16 is being fired at the front side 4 of the target plate 2. For example, the channel openings 12 may be connected to one or more capillary 15 for delivering liquid into the channel 8, e.g. for using an infusion pump 17 to replenish a channel or for delivering liquid into the channel directly from a liquid chromatography column 19 in an on-line LC-MALDI technique. Also, if the channel openings 12 in the rear side 6 of the target plate 2 are larger than those in the front side 4 of the target plate 2, then this more easily facilitates injection of the sample into the rear side of the target plate.

Once the sample 10 is loaded into the channels 8 of the target plate 2, the target plate is arranged proximate the inlet of a mass spectrometer. Alternatively, the sample may be loaded into the target plate whilst the target plate is proximate the inlet to the mass spectrometer. In the example shown in FIG. 1, the mass spectrometer has an inlet tube 5 for receiving the analyte and arranged in front of the inlet of a vacuum chamber of the mass spectrometer. A laser 16 is then directed onto the front side 4 of the target plate 2, at the opening 14 of one of the channels 8. The laser beam 16 causes the liquid sample 10 at the front opening 14 of the channel 8 to be desorbed and ionised. The analyte ions 18 then pass into the inlet tube 5, which may be heated so as to assist in the desorption and/or ionisation of the analyte. The analyte ions 18 then pass into the inlet of the vacuum chamber of the mass spectrometer. The analyte ions may be drawn into the inlet by a gas flow, e.g. due to the target plate being in a higher pressure region (e.g. atmospheric pressure) than the vacuum chamber.

As the liquid sample 10 is ionised and leaves the channel opening 14 in the front side of the target plate, the liquid 10 in the channel 8 moves towards the front opening 14 and may subsequently be ionised by the laser 16. The channels 8 may have a cross-sectional size and may be configured such that this motion of the liquid 10 is performed under capillary action. Alternately, or additionally, the liquid motion to the front side may be driven by applying a pressure differential across the target plate 2. For example, for any given channel 8, the opening 12 in the rear side of the target plate may be maintained at a higher pressure than the opening 14 in the front side of the target plate. This may be achieved by arranging the target plate as the interface between different pressure regions. Alternatively, a pump may be connected to the rear side of the channels 8 and used to apply pressure to the opening 12 in the rear side of the target plate.

It is also contemplated that the liquid sample 10 may be charged and a potential difference, such as an electrostatic field, may be applied between the target plate 2 and an electrode in front of the target plate (e.g. the inlet tube 5 or the vacuum chamber inlet) so as to urge the charged liquid towards the electrode, i.e. to force the liquid through the channels 8 to the front surface 4 of the target plate. For example, a 3 kV potential difference may be applied between the target plate 2 and the inlet tube 5. The liquid 10 may be electrically charged by applying a voltage directly to the liquid or by using an electrically conductive target plate 2 and applying a voltage to the target plate.

The pulsed laser 16 may be directed on one channel until it is desired to ionise the sample in another channel, at which point the laser beam 16 may be redirected so as to be incident on the next channel. The laser can be stepped between the various channels in this way. Alternatively, rather than redirecting the laser to ionise the sample in another channel, the sample plate 2 may be moved so that the laser 16 is incident on said another channel. The movement of the sample plate may be stepped so that the laser beam is incident on the different channels. It is also contemplated that multiple lasers or multiple laser beams may be used to illuminate multiple different channels.

One or more detector 20 may be provided for sensing the laser beam 16 and/or target plate position and controlling this position to optimise the direction of the laser onto any given channel. The one or more detector may form part of a control system for controlling the position of the laser beam and/or target plate. For example, a photodetector may be used to detect light from the laser beam to ensure the laser is in the correct position relative to a channel. The photodetector may be arranged on the opposite side of the target pate to the laser and may be used to determine when the laser beam is in the correct position, e.g. when light from the laser is passing through the channel onto the detector (e.g. with maximum intensity).

The above-described target plate structure ensures that the surface area of the sample at each opening 14 in the front side of the target plate is relatively small, allowing a high sample density per unit area. Also, this small surface area of the sample in each channel helps to define the electric field more precisely than the electrostatically undefined liquid spots normally used.

In order to illustrate the effectiveness of the embodiments of the invention, a specific example will now be described. An AP-MALDI source assembly was fitted to a Synapt G2 Si instrument. The standard ESI source housing of the instrument was removed. A heated ion transfer/desolvation inlet tube was fitted and a target plate loaded with sample was positioned in front of the ion transfer tube on an X-Y target plate carrier, i.e. as shown in FIG. 1. Each channel was configured as in FIG. 1 and had a volume of 10 μL. A 5 μL bradykinin peptide solution (10 pm per μL) had been spotted onto the channel from the rear of the sample plate together with 5 μL of the liquid matrix (50 mg of 2,5-DHB dissolved in 100 μL of 50:50 water/acetonitrile solution followed by the addition of 60% glycerol by volume). A potential difference of 4 kV was applied between the MALDI target plate and the ion transfer tube. The samples were then irradiated by a pulsed DPSS Nd:YLF laser (349 nm; ~8 ns).

Figure 2A:
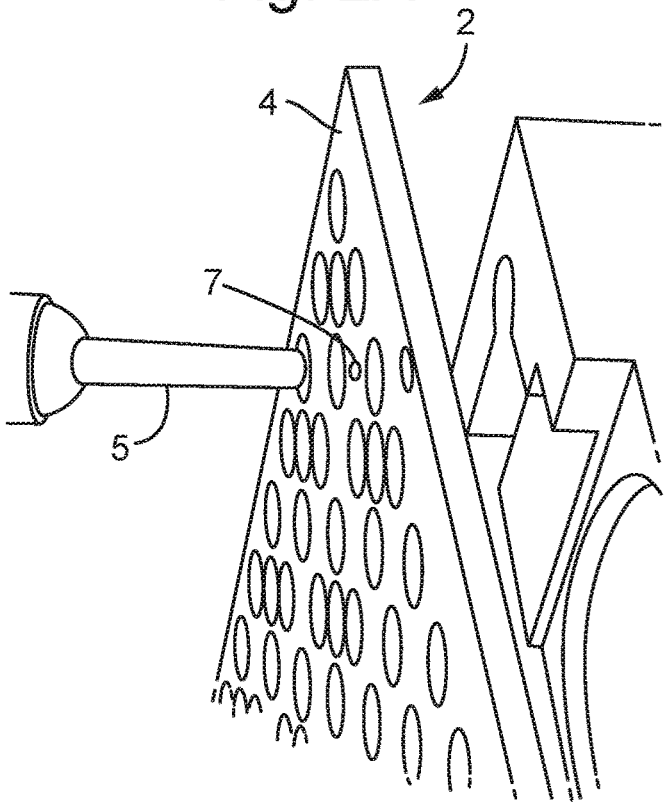
FIG. 2A shows a view of the front side of the target plate.

FIG. 2A shows a view of the front side 4 of the target plate 2, including a view of the tip of heated inlet tube 5 and the laser spot 7 from a laser (firing at 1 kHz).

Figure 2B:
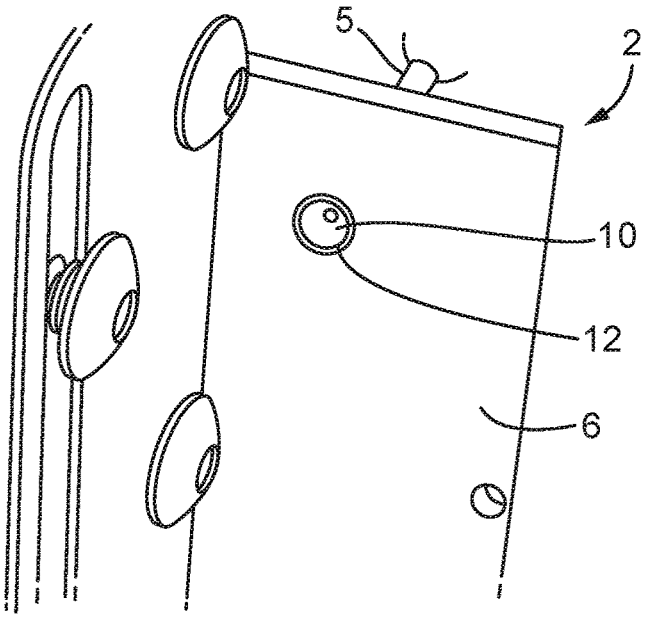
FIG. 2B shows a view of the rear side of target plate.

FIG. 2B shows a view of the rear side 6 of target plate 2, showing the relatively large opening 12 into the channel 8 and the laser fluorescence of the liquid AP-MALDI sample/matrix solution 10.

Figure 3:
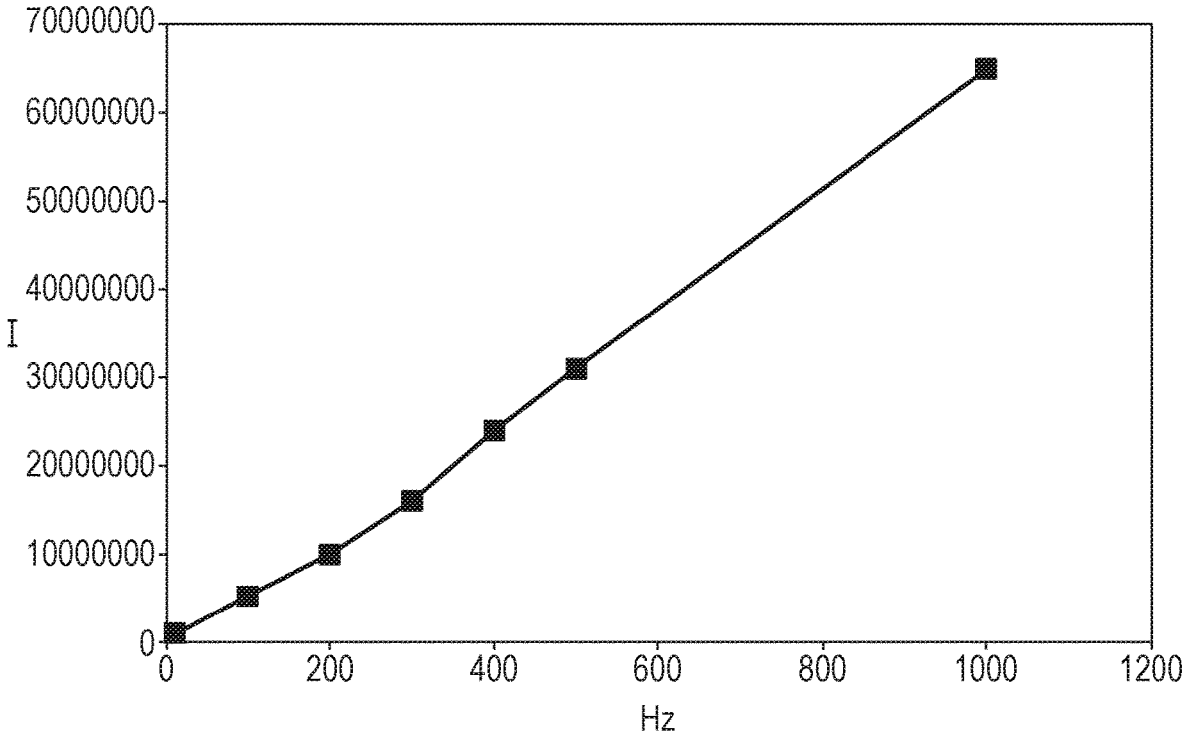
FIG. 3 the ion signal obtained as a function of laser pulse rate for an embodiment of the invention.

FIG. 3 shows the ion signal obtained as a function of laser pulse rate using the above described embodiment for 2+ bradykinin (5 pm per μL) with DHB and glycerol. More specifically, the graph illustrates the signal (summation of 10×1 second scans) as a function of laser repetition rate.

The target plate structure according to the embodiments of the invention allows high rate laser repetition acquisition from significantly larger sample volumes than conventionally used. Experimental speeds, for a given sample volume, can be significantly increased, e.g. by at least two orders of magnitude.

Although a reflection mode MALDI technique has been described, wherein the laser beam illuminates the side of the target plate from which the analyte ions are emitted, it is also contemplated that a transmission mode MALDI technique may be used. In such a transmission mode technique, the laser may be directed from the rear side of the target plate, through the target plate and onto the sample in the channel and such that analyte ions are emitted from the front side of the target plate.

Figure 4:
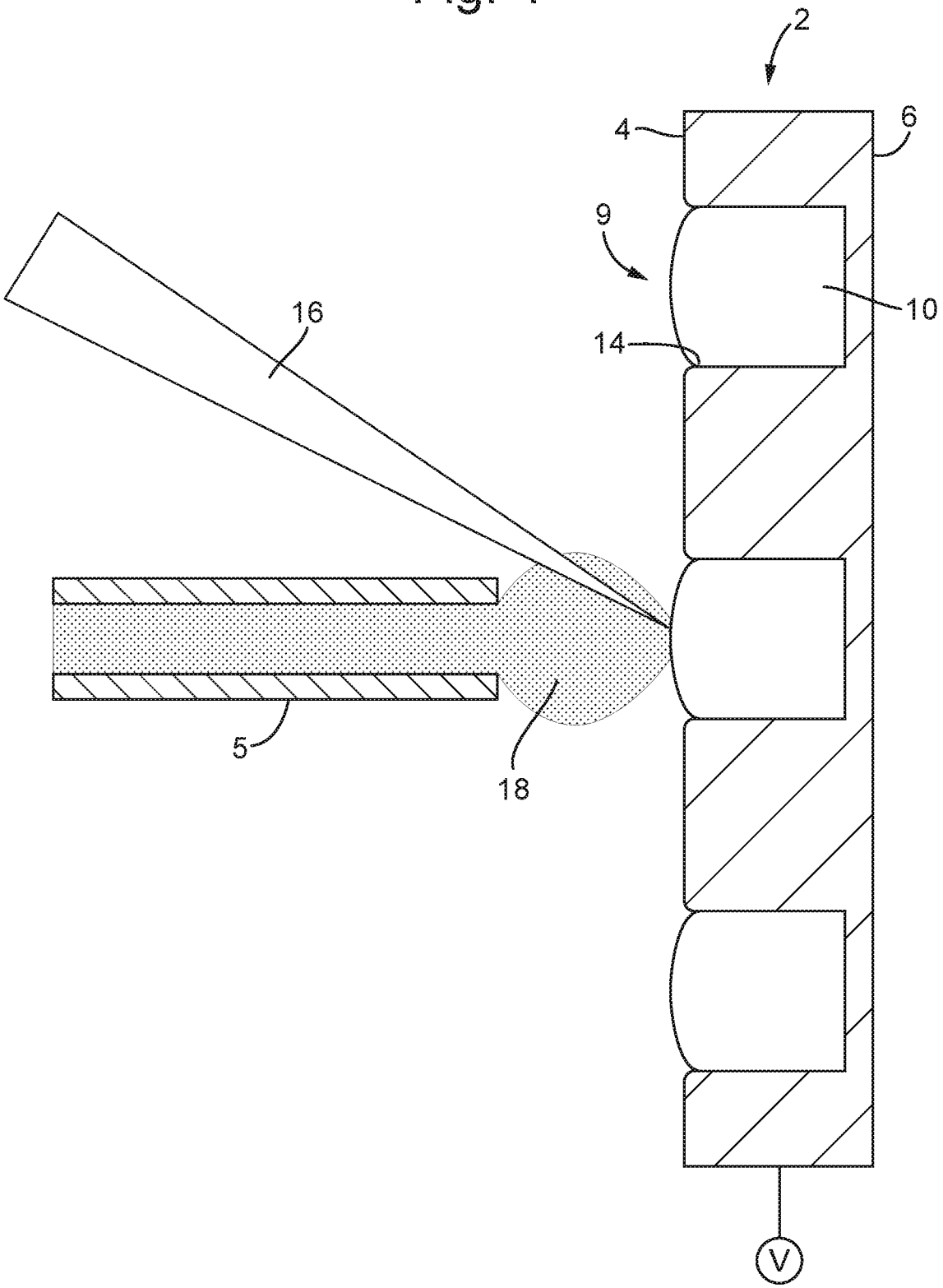
FIG. 4 shows an embodiment of the invention having sample receiving wells.

FIG. 4 shows a less preferred embodiment of the invention that is substantially the same as that shown and described in relation to FIG. 1, except that high volume wells 9 (e.g. ~1 mL each) are provided in the target plate 2 rather than providing channels through the target plate. The target plate may comprise a 1D or 2D array of such wells (or even only a single such well). For example, the target plate may comprise 96 wells in a 2D array.

Although the present invention has been described with reference to preferred embodiments, it will be understood by those skilled in the art that various changes in form and detail may be made without departing from the scope of the invention as set forth in the accompanying claims.

For example, additional chromatographic material may be added to the sample, optionally for desalting.

Salts or other additives may be added to the sample, e.g. to enhance the liquid dipole features and hence the electrostatic drive through the target plate.

The target plate may be a microfabricated plate, e.g. with additional functional structures or interconnected channels for mixing of different solutions.

Although the various channels and well configurations are described herein, it is contemplated that a target plate may comprise a plurality of these different configurations of channels or a plurality of these different configurations of wells. It is also contemplated that a target plate may comprise both one or more of the channels and one or more of the wells.

Although embodiments have been described in which the sample is ionised by a MALDI technique, it is contemplated that the target plate may be used in other ionisation techniques, such as Laser Desorption Ionisation ("LDI"), Solvent Assisted Inlet Ionisation ("SAII"), Desorption Electrospray Ionisation ("DESI"), Rapid Evaporative Ionization Mass Spectrometry (REIMS), Laserspray Ionisation ("LSI"), Ultrasonic Desorption, Atmospheric Sample Analysis Probe (ASAP) ionisation or other ambient ionization techniques.

The invention claimed is:

1. A liquid MALDI ion source comprising:

a target plate having a front surface, a rear surface, and at least one sample receiving well for receiving a liquid sample or at least one sample receiving channel extending from an opening in the rear surf ace to an opening in the front surface for receiving a liquid sample, wherein each well or channel has a volume of ≥50 μL; and a laser for ionising a liquid sample on or in the target plate, wherein the laser is a pulsed laser set up and configured to have a pulsed repetition rate of ≥30 Hz, or is a continuous laser.

2. The ion source of claim 1, wherein for any given channel the opening on the rear side of the target plate has a larger area than the opening on the front side of the target plate.

3. The ion source of claim 1, comprising at least one sample supply capillary connected to the opening in the rear side of target plate of the at least one channel.

4. The ion source of claim 3, comprising a pump connected to the capillary for pumping the sample or another liquid to the channel through the capillary;

and/or comprising a liquid chromatography column connected to the opening in the rear side of target plate of the at least one channel.

5. The ion source of claim 1, comprising a pump for creating a pressure differential between the rear and front openings of the at least one channel so as to urge sample towards the front opening.

6. The ion source of claim 1, wherein said at least one channel is configured such that desorption of the sample at the channel opening in the front side of the target plate draws the remainder of the sample through the channel under capillary action to the opening in the front side.

7. The ion source of claim 1, wherein the cross-sectional area of any given channel continuously tapers or is stepped from a first area arranged towards the rear side of the target plate to a second smaller area arranged towards a front side of the target plate.

8. The ion source of claim 1, wherein the laser is a pulsed laser having a laser pulse rate of ≥40 Hz, ≥50 Hz, ≥60 Hz, ≥80 Hz, ≥100 Hz, ≥200 Hz, ≥300 Hz, ≥400 Hz, ≥500 Hz, ≥600 Hz, ≥700 Hz, ≥800 Hz, ≥900 Hz, ≥1 kHz, >2 kHz, ≥3 kHz, ≥4 kHz, ≥5 kHz, ≥10 kHz, or ≥50 kHz.

9. The ion source of claim 1, wherein each of said at least one channel or well has a volume of: ≥60 μL, ≥70 μL, ≥80 μL, ≥90 μL, ≥100 μL, ≥200 μL, ≥300 μL, ≥400 μL, ≥500 μL, ≥600 μL, ≥700 μL, ≥800 μL, ≥900 μL, ≥1 mL, ≥2 mL, ≥3 mL, ≥4 mL, or ≥5 mL.

10. The ion source of claim 1, wherein the ion source is an atmospheric pressure ion source.

11. The ion source of claim 1, wherein the target plate comprises a 1D or 2D array of said channels or wells spaced in the plane orthogonal to the direction between the front and rear surfaces of the target plate.

12. The ion source of claim 1, comprising a laser controller for moving a laser beam from the laser between different ones of said channels or wells at different times; and/or comprising a target plate carrier configured for moving the target plate so that the laser beam is incident on different ones of said channels or wells at different times; and comprising a position control system having one or more detector for sensing the laser beam and/or target plate position and a controller for controlling this position so as to direct the laser beam onto an opening of the channel or well.

13. The ion source of claim 12, wherein the one or more detector comprises a photodetector arranged on the opposite side of the target pate to the laser, wherein the control system is configured to control the position of the laser beam and/or target plate so that the laser beam passes through the channel to be incident on the photodetector.

14. The ion source of claim 1, comprising at least one voltage source arranged and configured for charging the liquid sample and to provide an electric field for urging the liquid sample through the channel or well towards the front side of the target plate.

15. A mass spectrometer comprising the ion source of claim 1 and a mass analyser and/or ion mobility analyser for analysing ions from the ion source.

16. A method of ionising a sample comprising:

providing an ion source as claimed in claim 1;

providing a liquid sample to said target plate; and ionising said sample.

17. The method of claim 16, wherein the sample is a liquid sample and said step of ionising the sample is performed by directing the laser onto the liquid sample.

18. The method of claim 17, comprising driving the liquid sample through the target plate whilst ionising said liquid sample on or in the target plate; or wherein ionisation of the liquid sample on or in the target plate draws the sample through the at least one sample receiving well or channel.

19. A liquid MALDI ion source comprising:

a target plate having at least one sample well extending only partially through the thickness of the target plate for receiving a liquid sample, wherein each well has a volume of ≥50 μL; and a laser for directing a laser beam onto the at least one well for ionising a sample in said well, wherein the laser is a pulsed laser set up and configured to have a pulsed repetition rate of ≥100 Hz, or is a continuous laser.

20. A liquid MALDI ion source comprising:

a target plate having a front surface, a rear surface, and at least one sample receiving channel extending from an opening in the rear surface to an opening in the front surface for receiving a liquid sample, wherein for any given channel the opening on the rear side of the target plate has a larger area than the opening on the front side of the target plate; and a laser for ionising a liquid sample at the opening of the at least one channel in the front surface of the target plate, wherein the laser is a pulsed laser set up and configured to have a pulsed repetition rate of ≥30 Hz, or is a continuous laser, wherein said at least one channel is configured such that desorption of the liquid sample at the opening in the front surf ace of the target plate by the laser draws the remainder of the liquid sample through the channel under capillary action to the opening in the front side.

* * * * *